US009635743B2

(12) United States Patent
Magielse et al.

(10) Patent No.: US 9,635,743 B2
(45) Date of Patent: Apr. 25, 2017

(54) CONTROLLING NETWORKED LIGHTING DEVICES

(71) Applicant: PHILIPS LIGHTING HOLDING B.V., Eindhoven (NL)

(72) Inventors: Remco Magielse, Tilburg (NL); Hugo Jose Krajnc, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/093,165

(22) Filed: Apr. 7, 2016

(65) Prior Publication Data

US 2016/0302290 A1 Oct. 13, 2016

(30) Foreign Application Priority Data

Apr. 9, 2015 (EP) ..... 15162962

(51) Int. Cl.
*H05B 37/02* (2006.01)

(52) U.S. Cl.
CPC ..... *H05B 37/0272* (2013.01); *H05B 37/0227* (2013.01); *H05B 37/0281* (2013.01)

(58) Field of Classification Search
CPC ..... H05B 37/0272; H05B 37/0227; H05B 37/0281; H05B 33/0863; H05B 33/0869; H05B 33/0825
USPC ..... 315/154, 186, 307
See application file for complete search history.

(56) References Cited

U.S. PATENT DOCUMENTS 5,838,259 A * 11/1998 Tonkin ..... B60Q 1/444 340/464
6,133,852 A * 10/2000 Tonkin ..... B60Q 1/444 340/464
8,154,227 B1 * 4/2012 Young ..... A63H 19/24 318/255
8,581,513 B1 * 11/2013 Reinoso ..... H05B 37/0272 315/185 S
8,674,616 B2 * 3/2014 Holman ..... E04B 9/32 315/224
2003/0057886 A1 3/2003 Lys et al.
2010/0277340 A1 11/2010 Julio
(Continued)

FOREIGN PATENT DOCUMENTS

WO 2012033410 A2 3/2012
WO 2013034361 A1 3/2013

*Primary Examiner* — Douglas W Owens
*Assistant Examiner* — Syed M Kaiser

(57) ABSTRACT

A controller 100 for controlling a lighting device 110 via a network 108 is disclosed. The controller 100 comprises a receiver 102 arranged for receiving a first sequence of light settings distributed over a first plurality of points in time, which first sequence defines a dynamic light effect. The controller 100 further comprises a processor 104 arranged for converting the first sequence of light settings into a second sequence of light settings distributed over a second plurality of points in time. The controller 100 further comprises a transmitter 106 arranged for transmitting light settings to the lighting device 110. The processor 104 of the controller 100 is further arranged for receiving an indication of a network capacity of the network 108, and the processor 104 is further arranged for converting the first sequence of light settings into the second sequence of light settings based on the indication of the network capacity.

15 Claims, 4 Drawing Sheets

(56) References Cited

U.S. PATENT DOCUMENTS

| | | | | |
|---|---|---|---|---|
| 2013/0026945 | A1* | 1/2013 | Ganick | G01S 1/70 315/246 |
| 2014/0062297 | A1* | 3/2014 | Bora | H05B 33/0863 315/34 |
| 2014/0167621 | A1* | 6/2014 | Trott | H05B 37/0218 315/154 |
| 2014/0285096 | A1 | 9/2014 | Cuppen et al. | |
| 2015/0046074 | A1* | 2/2015 | Challapali | G08G 1/081 701/117 |
| 2016/0323972 | A1* | 11/2016 | Bora | H05B 33/0842 |

* cited by examiner

CONTROLLING NETWORKED LIGHTING DEVICES

CROSS-REFERENCE TO PRIOR APPLICATIONS

This application claims the benefit of European Patent Application No. 15162962.3, filed on Apr. 9, 2015. This application is hereby incorporated by reference herein.

FIELD OF THE INVENTION

The invention relates to a controller and a method for controlling a lighting device via a network. The invention further relates to a computer program product for performing the method.

BACKGROUND

Future and current home and professional environments will contain a large number of controllable lighting devices for creation of ambient, atmosphere, accent or task lighting. These controllable lighting devices are often connected and controlled via a (wireless) network. These lighting devices can be controlled individually or in groups via a user interface of a smart device (e.g. a smartphone or a tablet pc). Often, control of these lighting devices comprises communicating multiple lighting control commands, especially for dynamic light effects. A dynamic light effect comprises a plurality of light settings that change over time when applied to a (set of) lighting device(s). Current lighting control network systems may not be able to transfer all lighting control commands because of limitations of the network bandwidth. These limitations can be caused by, for example, an overflow of traffic the on the network. Current solutions, as for example disclosed in patent application US2010277340A1, solve this problem by sending single control commands, wherein the single control commands comprise instructions for a dynamic light effect, thereby reducing the need for a constant data stream. This, however, requires that each lighting fixture is equipped with its own local controller that translates the single commands into usable lighting controls. Furthermore, this does not guarantee the desired performance, because the dynamic light effect may need to be altered frequently.

SUMMARY OF THE INVENTION

It is an object of the present invention to provide a controller, a method and a computer program product for instantly applying a dynamic light effect to a lighting device over a network.

According to a first aspect of the present invention the object is achieved by a controller for controlling a lighting device via a network. The controller comprises:

a receiver arranged for receiving a first sequence of light settings distributed over a first plurality of points in time, which first sequence defines a dynamic light effect, a processor arranged for converting the first sequence of light settings into a second sequence of light settings distributed over a second plurality of points in time, and a transmitter arranged for transmitting light settings to the lighting device, wherein the processor is further arranged for receiving an indication of a network capacity of the network, and wherein the processor is further arranged for converting the first sequence of light settings into the second sequence of light settings based on the indication of the network capacity.

The dynamic light effect (i.e. the first sequence of light settings) may, for example, be selected by a user on a user input device and be received by the receiver of the controller. It is desired that the dynamic light effect is applied instantly to the lighting device upon selection of the dynamic light effect, so the user does not have to wait for the lighting effect to be applied. It is further desired that the user experiences the dynamic light effect as it was intended. The processor creates the second sequence of light settings based on the first sequence of light settings. This allows the processor to determine, for example, to remove specific light settings from the first sequence, which may be beneficial if the network capacity (e.g. the bandwidth of the network, the network load, download speed of the network, etc.) limits the number of light settings that can be transmitted within a period of time. By reducing the number of light settings, the processor enables that the lighting device receives the second sequence of light settings with a smaller delay. Since the second sequence of light settings is based on the first sequence of light settings, the controller enables the lighting device to apply the new dynamic light effect of the second sequence similar to the original dynamic light effect of the first sequence. Thus, the controller is able to communicate the dynamic light effect instantly to the lighting device upon selection and apply the second sequence of light effects without exceeding the network capacity, thereby using the network optimally and creating an optimal user experience. Alternatively, the processor may increase the number of light settings of the second sequence relative to the first sequence. This may be beneficial when the network capacity allows a greater number of light setting to be transmitted per time period than the number of light settings of the first sequence. This may further enable the controller to improve the transitions between light settings of the first sequence.

The transmitter of the controller is arranged for transmitting the light settings to the lighting device. In order to transmit these light settings, the processor may be arranged for generating messages, signals or data packets suitable to be applied by the lighting device. The message, signal or data packet may comprise computer readable data comprising, for example, message/signal/data packet destination information, message/signal/data packet source information, light setting information, sequence information, etc. The transmitter may transmit these messages, signals or data packets via any communication protocol (e.g. Wi-Fi, ZigBee, Bluetooth, DALI, DMX, USB, power over Ethernet, power-line communication, etc.). It may be beneficial if the controller is arranged for communicating via a plurality of communication channels/protocols, thereby enabling the transmission of messages, signals or data packets to a plurality of types of lighting devices.

In an embodiment of the controller, the processor is arranged for receiving an indication of a network utilization relative to a predetermined network capacity, and the processor is further arranged for converting the first sequence of light settings into the second sequence of light settings based on the indication of the network utilization. It is advantageous to determine the second sequence of light settings based on the indication of the network utilization, because it allows the processor to use the network optimally without exceeding its capacity. Furthermore, it may reduce the delay between applying each of the light settings to the lighting device, which results in an optimized user experience.

In a further embodiment of the controller, the processor is arranged for determining the number of light settings of the second sequence as a function of the network utilization. The network utilization may be based on a current number and/or type of messages, signals or data packets that are accommodated by the network at a specific point in time. When the network utilization is high, the processor may determine to convert the first sequence of light setting into the second sequence of light settings, wherein number of light settings of the second sequence is lower than the number of light setting of the first sequence. Alternatively, when the network utilization is low, the processor may determine to convert the first sequence of light setting into the second sequence of light settings, wherein number of light settings of the second sequence is higher than the number of light setting of the first sequence. This is beneficial because it allows the processor to use the network optimally without exceeding its capacity.

In an embodiment of the controller, the processor is arranged for receiving an indication of a bandwidth of the network, and the processor is further arranged for converting the first sequence of light settings into the second sequence of light settings based on the indication of the bandwidth. The bandwidth (i.e. the rate of data transfer in the network) further determines the capacity of the network. Therefore, it is advantageous if the processor is able to determine the number and/or type of light settings transmitted to the lighting device based on the indication of the bandwidth.

In an embodiment of the controller, the controller is further arranged for downloading the first sequence of light settings from a further device, and the processor is further arranged for determining which of the light settings of the first sequence to download based on the downloading speed of the signal. This is advantageous if, for example, the download speed is too low to download the first sequence in its entirety. The processor may determine to download the light settings to be transmitted to a lighting device at an early point in time first, and to download the light settings to be transmitted to a lighting device at a later point in time second. This allows the processor to instantly apply a first light setting of the dynamic light effect to the lighting device upon downloading, which may result in an optimized user experience, because at least one light setting is rendered directly after receiving the download command.

In a further embodiment of the controller, the processor is further arranged for generating a preliminary light setting if the first sequence of light settings has not been downloaded, and the transmitter is further arranged for transmitting the preliminary light setting to the lighting device before the first sequence has been downloaded. This embodiment allows the controller to apply a light setting upon receiving a selection of the dynamic light setting, even though the light setting may not be ready for transmission to the lighting device. This is advantageous because the user will receive feedback instantly upon selecting the dynamic light effect, because the preliminary light setting is applied instantly to the lighting device, thereby improving the user experience of the lighting control. The preliminary light setting may be based on at least one of the group comprising: a predetermined light setting, a user specified light setting, a default light setting, a previous light setting and a preview light setting.

In an embodiment of the controller, the processor is arranged for combining at least two light settings of the first sequence of light settings into one light setting. This may be beneficial when the number of light settings of the first sequence needs to be reduced. For example, the processor may combine a first light setting of the first sequence at t1 (a first point in time) and combine a second light setting of the first sequence at t2 (a second point in time) and generate a combined light setting. Next, the combined light setting may be implemented in the second sequence of light setting. The combined light setting may be, for example, an interpolation of the hue, saturation, colour temperature, intensity or brightness of the first and the second light settings.

In an embodiment of the controller, the processor is arranged for generating a transition light setting, the transition light setting being a light setting in between two sequential light settings of the first sequence of light settings. Similar to the above-mentioned combined light setting, the transition light may be for example an interpolation of the hue, saturation, colour temperature, intensity or brightness of the two sequential light settings. The processor may be further arranged for generating a plurality of transition light settings in between two sequential light settings, enabling the creation of an improved transition between the two sequential light settings.

In an embodiment of the controller, the controller further comprises a user interface arranged for receiving a user input, the user input being representative of selecting the dynamic light effect. The processor may be further arranged for processing the user input received from a user via the user interface. The user interface may, for example, comprise a touch-sensitive device such as a touchpad or a touchscreen, an audio sensor such as a microphone, a motion sensor such as an accelerometer and/or a gyroscope for detecting movement and/or one or more buttons for receiving the user input.

According to a second aspect of the present invention the object is achieved by a method of controlling a lighting device via a network, the method comprising the steps of:

receiving a first sequence of light settings distributed over a first plurality of points in time, which first sequence defines a dynamic light effect, receiving an indication of a network capacity of the network, converting the first sequence of light settings into a second sequence of light settings distributed over a second plurality of points in time based on the indication of the network capacity, and transmitting the second sequence of light settings to the lighting device.

In an embodiment of the method, the first sequence of light settings is repeated over time, and the light settings of the first sequence are distributed between the second sequence of light settings and a third sequence of light settings, the second sequence of light settings being distributed over the second plurality of points in time and the third sequence of light settings being distributed over a third plurality of points in time. The second sequence and the third sequence are transmitted at a first moment in time and a second moment in time respectively. Additionally, the method may further comprise the steps of:

receiving, by the lighting device, the second sequence of light settings, applying, by the lighting device, the second sequence of light settings, receiving, by the lighting device, the third sequence of light settings, and applying, by the lighting device, when the second sequence of light settings is repeated, the second sequence of light settings and the third sequence of light settings, thereby recreating the first sequence of light settings.

This provides the advantage that it enables an increase of resolution (i.e. the amount of light settings applied by the lighting device per time unit) of a repetitive dynamic light effect over time. During a first repetitive cycle, only the second sequence of light settings is applied by the lighting device, while during a second repetitive cycle, the second and the third sequences of light settings are applied by the lighting device, thereby recreating the first sequence of light settings.

In an embodiment of the method, each light setting comprises at least one of the group comprising:

a static light setting, the static light setting being a light setting at a point in time, and a transitional light setting, the transitional light setting being a transition from a first static light setting at a first point in time to a second static light setting at a second point in time.

According to a third aspect of the present invention the object is achieved by a computer program product for a computing device, the computer program product comprising computer program code to perform any one of the methods according to the invention when the computer program product is run on a processing unit of the computing device.

BRIEF DESCRIPTION OF THE DRAWINGS

The above, as well as additional objects, features and advantages of the disclosed controller and methods, will be better understood through the following illustrative and non-limiting detailed description of embodiments of devices and methods, with reference to the appended drawings, in which.

All the figures are schematic, not necessarily to scale, and generally only show parts which are necessary in order to elucidate the invention, wherein other parts may be omitted or merely suggested.

DETAILED DESCRIPTION OF EMBODIMENTS

Figure 1:
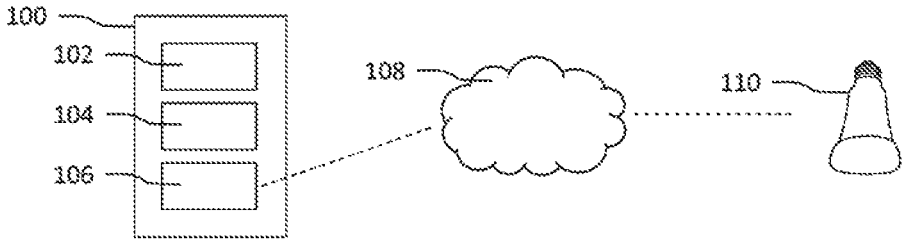
FIG. 1 shows schematically an embodiment of a controller according to the invention for controlling a lighting device via a network.

FIG. 1 shows schematically an embodiment of a controller 100 according to the invention for controlling a lighting device 110 via a network 108. The controller 100 comprises a receiver 102 arranged for receiving a first sequence of light settings distributed over a first plurality of points in time, which first sequence defines a dynamic light effect. The controller 100 further comprises a processor 104 arranged for converting the first sequence of light settings into a second sequence of light settings distributed over a second plurality of points in time. The controller 100 further comprises a transmitter 106 arranged for transmitting light settings to the lighting device 110. The processor 104 of the controller 100 is further arranged for receiving an indication of a network capacity of the network 108, and the processor 104 is further arranged for converting the first sequence of light settings into the second sequence of light settings based on the indication of the network capacity. The controller 100 may further comprise a battery (not shown) or auxiliary power for powering the different components of the controller 100.

The controller 100 may be any device arranged for controlling lighting devices 110. For example, the controller 100 may be a smart device (e.g. a smartphone, smart watch, smart glasses, laptop, tablet pc, pc, etc.) arranged for receiving the first sequence of light settings (i.e. the dynamic light effect) via, for example, a user interface, based on a user input provided by a user operating the smart device. The processor 104 of the smart device may convert the first sequence of light settings into the second sequence of light settings based on the indication of the network capacity. The transmitter 106 of the smart device may transmit the second sequence of light settings (for example via Bluetooth, Wi-Fi, Zigbee, 3G, 4G, or any other wireless protocol) to the lighting device 110. An advantage of using a smart device as a controller 100 is that it may already be equipped with the (wireless) communication protocols that are required to control a lighting device 110, and that a smart device may already comprise a user interface arranged for receiving user input related to the selection of the dynamic light effect. Alternatively, the controller 100 may be a routing device (e.g. a bridge, hub, router, central controller of a building management system, etc.) arranged for receiving the signal from a further device (e.g. from a smart device via Ethernet, Bluetooth, Wi-Fi or Zigbee) and the processor 104 of the routing device may convert the first sequence of light settings into the second sequence of light settings based on the indication of the network capacity. The transmitter 106 of the routing device may transmit the second sequence of light settings (for example via Bluetooth, Wi-Fi, Zigbee, 3G, 4G, Ethernet, DALI, DMX or any other wired or wireless protocol) to the lighting device 110. The advantage of using a routing device is that it may be arranged for communicating via a plurality of network 108 protocols to a plurality of lighting devices 110.

The receiver 102 of the controller 100 is arranged for receiving the first sequence of light settings distributed over a first plurality of points in time, which first sequence defines the dynamic light effect. The receiver 102 may be arranged for receiving the first sequence of light settings via an input. The input may be, for example, a signal or a message transmitted by a further device (e.g. a smartphone, a laptop, etc.) or the receiver 102 may comprise a means for receiving an input provided at the controller 100 (for example via a user interface, a button, a switch, a touch screen, etc. of the controller 100). The signal/message may comprise data comprising the first sequence of light settings. Upon receiving the first sequence of light settings, the receiver 102 may communicate the first sequence of light settings to the processor 104 of the controller 100.

The first sequence of light settings defines the dynamic light effect. The dynamic light effect may be any sequence of light settings distributed over a plurality of points in time. For example, the dynamic light effect may comprise 3 light settings:

a first light setting at a first point in time, the first light setting having a red coloured light output at full brightness, a second light setting at a second point in time, the second light setting having a red coloured light output at half brightness, and a third light setting at a third point in time, the third light setting having a blue coloured light output at full brightness. Upon receiving the first sequence of light settings, the processor 104 may, for example, determine to convert the 3 light settings into 2 light settings based on a low network capacity, and determine not to include the second light setting having the red coloured light output at half brightness, thereby enabling that the light settings are applied without delay.

The first sequence of light settings comprises a plurality of light settings distributed over a plurality of points in time. A light setting may be a static light setting, the static light setting being a light setting at a point in time. The static setting may be stored and transmitted as computer readable code and may comprise information about the light output. This information may comprise the colour, brightness, intensity, saturation, colour temperature, etc. of the light. Additionally, a light setting may be a transitional light setting, the transitional light setting being a transition from a first static light setting at a first point in time to a second static light setting at a second point in time. The transitional light setting may comprise information about the light output of the first and the second static light settings and/or it may comprise information of how the transition from the first static light setting to the second static light setting is applied (linear or logarithmic, hard or smooth, fast or slow, etc.).

Figure 3A:
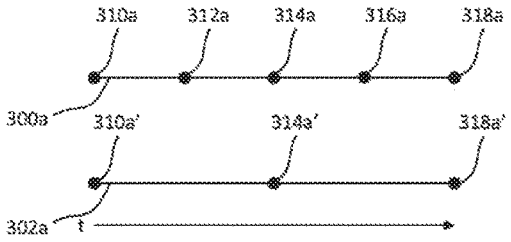
FIG. 3*a* shows schematically a first sequence of light settings and a second sequence of light settings.

The processor 104 of the controller 100 is arranged converting the first sequence of light settings into a second sequence of light settings distributed over a second plurality of points in time, based on the network capacity of the network 108 that is used to communicate the light settings from the controller 100 to the lighting device 110. The second plurality of points in time may be different from the first plurality of points in time. FIG. 3*a* illustrates how a first sequence 300*a* of light settings 310*a*-318*a* distributed over a first plurality of points in time (t) may be converted into a second sequence 302*a* of light settings 310*a*'-318*a*' distributed over a second plurality of points in time (t). The processor 104 may determine, based on the network capacity, to decrease the number of light settings of the second sequence 302*a* in order not to exceed the network capacity when the light settings are transmitted to the lighting device 110. The processor 104 may, for example, determine not to include light settings 312*a* and 316*a* in the second sequence 302*a*. This results in a new dynamic light effect 302*a* with less light settings, but with a character similar to the original light effect 300*a*. Further examples of how the processor 104 may convert the first sequence into the second sequence are described below in this description.

The processor 104 has access to information about the network capacity, which may be based on, for example, the maximum traffic that the network 108 allows, the current or maximum bandwidth of the network 108, the download/upload speed of the network 108, the type of communication protocol, etc. The processor 104 may receive information about the network capacity from a further device (e.g. from a network 108 router), or the processor 104 may comprise means to perform, for example, a ping test, download test or upload test in order to determine the network capacity.

The transmitter 106 of the controller 100 is arranged for transmitting the second sequence of light settings to the lighting device 110. The transmitter 106 may, for example, transmit each of the light settings over each of the second plurality of points in time, or the transmitter 106 may transmit a sequence in its entirety. The processor 104 may be further arranged for determining whether to send individual light settings or the sequence in its entirety, which determination may be, for example, based on the indication of the network capacity. The transmitter 106 may transmit the light settings or the entire sequence via a transmission signal or a message to the lighting device 110 according to any communication protocol (e.g. Bluetooth, Wi-Fi, Zigbee, 3G, 4G, Ethernet, DALI, DMX, etc.). The lighting device 110 may receive the signals/messages/data packets comprising the light settings or the entire sequence and apply the light settings accordingly. The lighting device 110 may be an LED bulb, an LED strip, a TLED, a Philips Hue lamp, an incandescent lamp, a fluorescent lamp, a high-intensity discharge lamp, etc. The lighting device 110 may be arranged for providing task lighting, ambient lighting, atmosphere lighting, accent lighting, etc.

Figure 2:
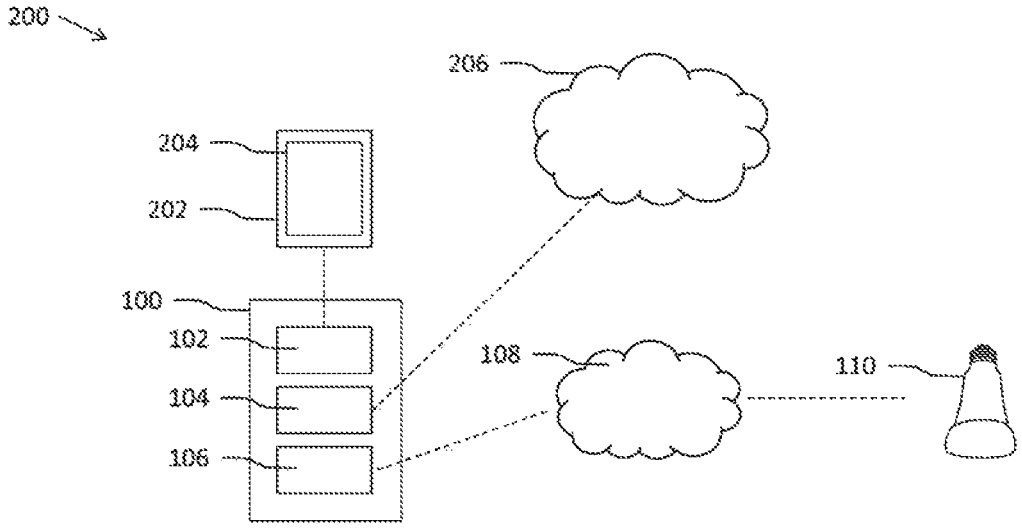
FIG. 2 shows schematically an embodiment of a system according to the invention for controlling a lighting device via a network.

FIG. 2 shows schematically an embodiment of a system 200 according to the invention for controlling a lighting device 110 via a network 108. The system 200 comprises the controller 100, the lighting device 110 and, optionally, a further device 202. The controller 100 comprises the receiver 102 arranged for receiving the first sequence of light settings distributed over a first plurality of points in time, which first sequence defines the dynamic light effect. The dynamic light effect may be selected on a user interface 204 on the controller 100 (not shown). Alternatively, the dynamic light effect may be received from the further device 202 (e.g. a user input device, such as a smartphone, tablet pc or smart watch). The further device 202 may comprise a user interface 204 arranged for receiving a user input, the user input being representative of the selection of the dynamic light effect. The user interface 204 may, for example, comprise a touch-sensitive device such as a touchpad or a touchscreen, an audio sensor such as a microphone, a motion sensor such as an accelerometer and/or a gyroscope for detecting gestures and/or one or more buttons or switches for receiving the user input. The controller 100 further comprises the processor 104 arranged for converting the first sequence of light settings into the second sequence of light settings distributed over a second plurality of points in time. The controller 100 further comprises the transmitter 106 arranged for transmitting light settings to the lighting device 110. The processor 104 of the controller 100 is further arranged for receiving an indication of a network capacity of the network 108, and the processor 104 is further arranged for converting the first sequence of light settings into the second sequence of light settings based on the network capacity. Additionally, the processor 104 of the controller 100 may be arranged for downloading the first sequence of light settings from another device 206. The other device 206 (e.g. a smartphone, a remote server, a home automation terminal, etc.) may comprise a storage means for storing at least one dynamic light effect.

In an embodiment, the processor 104 is arranged for receiving an indication of a network utilization relative to a predetermined network capacity. In this embodiment, the processor 104 is arranged for converting the first sequence of light settings into the second sequence of light settings based on the indication of the network utilization. The predetermined network capacity may be based on a maximum number and/or type of messages, signals or data packets that can be accommodated by the network 108 within a predetermined time period. The network utilization may be based on a current number and/or type of messages, signals or data packets that are accommodated by the network 108 at a specific point in time. It is advantageous when the controller 100 has access to information about the network utilization, because it enables the controller 100 to determine how to convert the first sequence of light settings into the second sequence of light settings without exceeding the network capacity. The processor 104 may receive information about the network capacity and the network utilization from a further device (e.g. from a network router) or the processor 104 may comprise means to perform, for example, a ping test, download test or upload test in order to determine the network capacity.

Additionally, the processor 104 may be arranged for determining the number of light settings of the second sequence as a function of the network utilization. The processor 104 may determine to decrease the number of light settings of the second sequence if the network utilization is higher, and the processor 104 may determine to increase the number of light settings of the second sequence if the network utilization is lower.

In an embodiment, the processor 104 is arranged for receiving an indication of a bandwidth of the network 108. In this embodiment, the processor 104 is arranged for converting the first sequence of light settings into the second sequence of light settings based on the indication of the bandwidth. The bandwidth of the network 108 (i.e. the rate of data transfer, bit rate or throughput of the network 108) may deter determine how to convert the first sequence of light settings into the second sequence of light settings without exceeding the bandwidth of the network 108. The processor 104 may receive information about the bandwidth from a further device (e.g. from a network 108 router), or the processor 104 may comprise a testing means to perform, for example, a ping test, download test or upload test in order to determine the bandwidth.

In an embodiment, the controller 100 is further arranged for downloading the first sequence of light settings from a further device. The further device (e.g. a smartphone, a remote server, a home automation terminal, etc.) may comprise a storage means for storing at least one dynamic light effect. A user may select a specific dynamic light effect on a user interface, whereafter the controller 100 may download the first sequence of light settings from the further device. The processor 104 of the controller 100 may determine, for example, to download a part of the first sequence based on the download speed. The processor 104 may determine to first download the light settings that are to be applied to the lighting device 110 at an earlier point in time, and second the light settings that are to be applied to the lighting device 110 at a later point in time. In an exemplary embodiment, the first sequence may consist of 10 light settings (S1, S2, . . . , S10), distributed over 10 points in time (t1, t2, . . . , t10). The processor 104 may determine to first download light setting S1 at the first point in and to transmit light setting S1 to the lighting device 110 in order to apply the light setting at corresponding time t1. Simultaneously, the processor 104 may download light setting S2 at the second point in time, whereafter the transmitter 106 may transmit light setting S2 to the lighting device 110 in order to apply the light setting at corresponding time t2. The further light settings (S3, . . . , S10) may be subsequently downloaded and transmitted to be applied at corresponding times (t3, . . . t10) accordingly.

In a further embodiment, the processor 104 is arranged for generating at least one preliminary light setting if the first sequence of light settings has not been downloaded. This is advantageous when a user selects a dynamic light effect via a user input device or a user interface. The controller 100 applies the preliminary light setting instantly to the lighting device 110, allowing the user to see to which lighting device 110 the yet to be downloaded first sequence (the dynamic light effect) will be applied. This improves the user experience because the user instantly receives visual feedback upon selecting the dynamic light effect. The preliminary light setting may be a predetermined light setting (e.g. a specific light colour), which is predetermined by the controller 100. Alternatively, the preliminary light setting may be a user specified light setting, which has been predefined by the user via, for example, a user interface. Alternatively, the preliminary light setting may be a default light setting, the default light setting being the default light setting of the lighting device 110. Alternatively, the preliminary light setting may be a previous light setting, the previous light setting being a light setting that was applied to the lighting device 110 before the dynamic light effect has been selected. Alternatively, the preliminary light setting may be a preview light setting. The preview light setting may be stored in the controller 100, or in a device connected to the controller 100, which provides, for example, a low resolution dynamic light effect. For example, when the user selects a dynamic light effect that applies a rainbow colour effect (a change of colour of the light output of the lighting device 110 over time according to the colours of the rainbow) to the lighting device 110, the processor 104 may determine to apply a preview light effect (e.g. the colour red) in order to initiate the dynamic light effect. Upon selection of the rainbow colour effect, the user receives feedback instantly, because the preliminary setting is applied to the lighting device 110, even if the rainbow colour effect has not been downloaded yet.

Figure 3B:
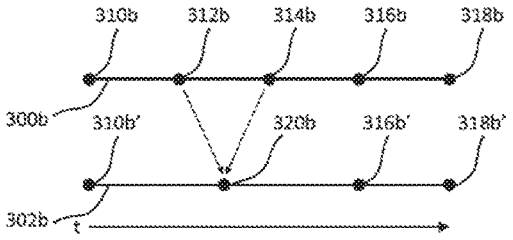
FIG. 3*b* shows schematically a first sequence of light settings and a second sequence of light settings, wherein two light settings of the first sequence of light settings are combined into one light setting of the second sequence of light settings.
Figure 3C:
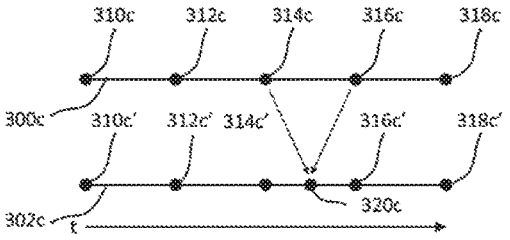
FIG. 3*c* shows schematically a first sequence of light settings and a second sequence of light settings, wherein the second sequence comprises a transition light setting, the transition light setting being a light setting in between two sequential light settings of the first sequence of light settings.

In an embodiment, the processor 104 is arranged for combining at least two light settings of the first sequence of light settings into one light setting. FIG. 3*b* illustrates how the processor 104 may combine two light settings 312*b*, 314*b* of the first sequence 300*b* distributed over a first plurality of points in time (t) into one light setting 320*b* of the second sequence 302*b*. The processor 104 may determine, based on the indication of the network capacity, to reduce the number of light settings of the second sequence 302*b* by combining light setting 312*b* and light setting 314*b* into one light setting 320*b*. Additionally or alternatively, the processor 104 is arranged for generating a transition light setting, the transition light setting being a light setting in between two sequential light settings of the first sequence of light settings. FIG. 3*c* illustrates how the processor 104 may generate the transition light setting 320*c*. The processor 104 may determine, based on the indication of the network capacity, to increase the number of light settings of the second sequence 302*c* by combining light settings 314*c* and 316*c* into transition light setting 320*c*. This may improve the smoothness of the transition from light setting 314*c* to 316*c*. Various methods known in the art may be used to combine light settings or to generate transition light settings. For example, interpolation between hue/colours, saturation level, light intensity level, colour temperature, x-y values in the colour diagram, etc. may be used to determine the combined light setting 320*b* and/or the transitional light setting 320*c*.

In an embodiment, the controller 100 further comprises a user interface arranged for receiving a user input, the user input being representative of a selection of the dynamic light effect. The user interface may, for example, comprise a touch-sensitive device such as a touchpad or a touchscreen, an audio sensor such as a microphone, a motion sensor such as an accelerometer and/or a gyroscope for detecting gestures and/or one or more buttons or switches for receiving the user input. The controller 100 may be a smart device (e.g. a smartphone, smart watch, smart glasses, laptop, tablet pc, pc, etc.) arranged for receiving the first sequence of light settings (i.e. the dynamic light effect) via, for example, a user interface, based on a user input provided by a user operating the smart device.

Figure 4A:
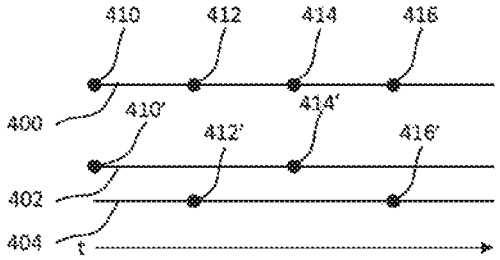
FIG. 4*a* shows schematically a first sequence of light settings, a second sequence of light settings and a third sequence of light settings.
Figure 4B:
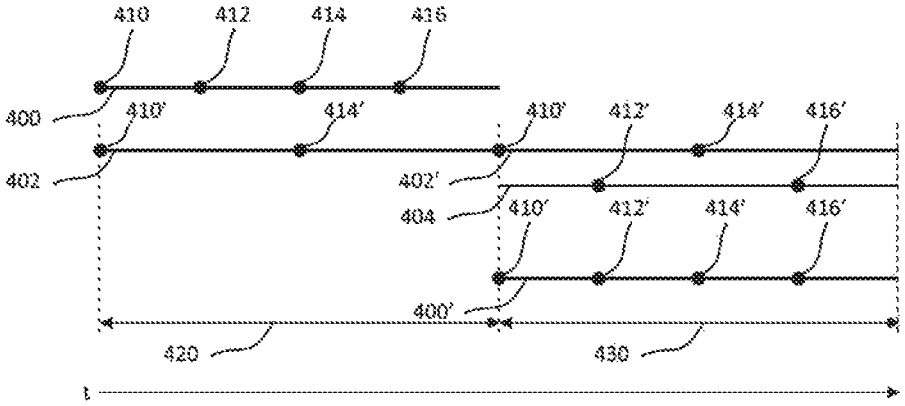
FIG. 4*b* shows schematically a first sequence of light settings that is repeated over time, and how a second sequence of light settings and a third sequence of light settings are created and combined in order to recreate the first sequence of light settings over time.

In an embodiment, the first sequence of light settings (i.e. the dynamic light effect) is repeated over time. This implies that the dynamic light effect is repeated at least once after the dynamic light effect has been applied by the lighting device 110. In this embodiment, wherein the first sequence of light settings is a repetitive dynamic light effect, the processor 104 may determine to distribute the light settings of the first sequence between the second sequence of light settings and a third sequence of light settings, the second sequence of light settings being distributed over the second plurality of points in time and the third sequence of light settings being distributed over a third plurality of points in time. FIG. 4*a* illustrates how the first sequence 400 of light settings 410, 412, 414, 416 may be distributed between the second sequence 402 of light settings 410', 414' and the third sequence 404 of light settings 412', 416'. Upon receiving the signal or message that comprises the second sequence 402 of light settings, the lighting device 110 may apply the second sequence 402 of light settings 410', 414'. Meanwhile, the lighting device 110 may receive the third sequence 404 of light settings 412', 416'. When the repetitive dynamic light effect is repeated, the lighting device 110 may apply both the second sequence 402 of light settings 410', 414' and the third sequence 404 of light settings 412', 416', thereby recreating the first sequence of light settings. FIG. 4*b* illustrates the execution of the second sequence 402, based on the first sequence 400 of light settings during a first cycle 420. FIG. 4*b* further illustrates the execution of both the second sequence 402' and the third sequence 404 during a second cycle 430, thereby recreating the first sequence 400' of light settings 410', 412', 414', 416' during the second cycle 430.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer or processing unit. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A controller for controlling a lighting device via a network, the controller comprising:

a receiver arranged for receiving a first sequence of light settings distributed over a first plurality of points in time, which first sequence defines a dynamic light effect, a processor arranged for converting the first sequence of light settings into a second sequence of light settings distributed over a second plurality of points in time, and a transmitter arranged for transmitting light settings to the lighting device, wherein the processor is further arranged for receiving an indication of a network capacity of the network, and wherein the processor is further arranged for converting the first sequence of light settings into the second sequence of light settings based on the indication of the network capacity.

2. The controller of claim 1, wherein the processor is arranged for receiving an indication of a network utilization relative to a predetermined network capacity, and wherein the processor is further arranged for converting the first sequence of light settings into the second sequence of light settings based on the indication of the network utilization.

3. The controller of claim 2, wherein the processor is arranged for determining the number of light settings of the second sequence as a function of the network utilization.

4. The controller of claim 1, wherein the processor is arranged for receiving an indication of a bandwidth of the network, and wherein the processor is further arranged for converting the first sequence of light settings into the second sequence of light settings based on the indication of the bandwidth.

5. The controller of claim 1, wherein the controller is further arranged for downloading the first sequence of light settings from a further device, and wherein the processor is further arranged for determining which of the light settings of the first sequence to download based on the downloading speed of the signal.

6. The controller of claim 5, wherein the processor is further arranged for generating at least one preliminary light setting if the first sequence of light settings has not been downloaded, and wherein the transmitter is further arranged for transmitting the preliminary light setting to the lighting device before the first sequence has been downloaded.

7. The controller of claim 6, wherein the processor is further arranged for generating the preliminary light setting based on at least one of the group comprising: a predetermined light setting, a user specified light setting, a default light setting, a previous light setting and a preview light setting.

8. The controller of claim 1, wherein the processor is arranged for combining at least two light settings of the first sequence of light settings into one light setting.

9. The controller of claim 1, wherein the processor is arranged for generating a transition light setting, the transition light setting being a light setting in between two sequential light settings of the first sequence of light settings.

10. The controller of claim 1, wherein the controller further comprises a user interface arranged for receiving a user input, the user input being representative of selecting the dynamic light effect.

11. A method of controlling a lighting device via a network, the method comprising the steps of:

receiving a first sequence of light settings distributed over a first plurality of points in time, which first sequence defines a dynamic light effect, receiving an indication of a network capacity of the network, converting the first sequence of light settings into a second sequence of light settings distributed over a second plurality of points in time based on the indication of the network capacity, and transmitting the second sequence of light settings to the lighting device.

12. The method of claim 11, wherein the first sequence of light settings is repeated over time, and wherein the light settings of the first sequence are distributed between the second sequence of light settings and a third sequence of light settings, the second sequence of light settings being distributed over the second plurality of points in time and the third sequence of light settings being distributed over a third plurality of points in time, and wherein the second sequence and the third sequence are transmitted at a first moment in time and a second moment in time respectively.

13. The method of claim 12, further comprising the steps of:

receiving, by the lighting device, the second sequence of light settings, applying, by the lighting device, the second sequence of light settings, receiving, by the lighting device, the third sequence of light settings, and applying, by the lighting device, when the second sequence of light settings is repeated, the second sequence of light settings and the third sequence of light settings, thereby recreating the first sequence of light settings.

14. The method of claim 11, wherein each light setting comprises at least one of the group comprising:

a static light setting, the static light setting being a light setting at a point in time, and a transitional light setting, the transitional light setting being a transition from a first static light setting at a first point in time to a second static light setting at a second point in time.

15. A computer program product for a computing device, the computer program product comprising computer program code to perform the method of claim 11 when the computer program product is run on a processing unit of the computing device.

* * * * *